US005382025A

United States Patent [19]

Sklansky et al.

[11] Patent Number: 5,382,025

[45] Date of Patent: Jan. 17, 1995

[54] METHOD FOR PLAYING A POKER GAME

[75] Inventors: David B. Sklansky; Daniel A. Jones, both of Las Vegas, Nev.

[73] Assignee: D & D Gaming Patents, Inc., Pompano Beach, Fla.

[21] Appl. No.: 88,785

[22] Filed: Jul. 8, 1993

Related U.S. Application Data

[60] Continuation-in-part of Ser. No. 800,631, Nov. 27, 1991, Pat. No. 5,288,077, which is a continuation-in-part of Ser. No. 361,276, Jun. 5, 1989, Pat. No. 5,078,405, which is a division of Ser. No. 214,934, Jul. 5, 1988, Pat. No. 4,861,041, which is a continuation-in-part of Ser. No. 182,374, Apr. 18, 1988, Pat. No. 4,863,553.

[51] Int. Cl.[6] ..... A63F 1/00

[52] U.S. Cl. ..... 273/292; 273/85 CP; 273/309

[58] Field of Search ..... 273/292, 274, 309, 85 CP

[56] References Cited

U.S. PATENT DOCUMENTS

| | | | |
|---|---|---|---|
| 1,238,736 | 9/1917 | Barrett | 193/2 |
| 1,527,929 | 2/1925 | Simons | 273/274 |

(List continued on next page.)

FOREIGN PATENT DOCUMENTS

| | | | |
|---|---|---|---|
| 338644 | 10/1989 | European Pat. Off. | 273/292 |
| 2830216 | 1/1980 | Germany . | |
| 3003376 | 8/1981 | Germany . | |
| 2169736 | 7/1986 | United Kingdom | 273/85 CP |
| 2184029 | 6/1987 | United Kingdom . | |

OTHER PUBLICATIONS

Scarne's Encyclopedia of Games, "Hold'em", Harper & Row Publishers, 1973, pp. 14–18, 26.

State of New Jersey Casino Control Commission PRN 217205 Civil Action IGT's Second Amended Petition for the Authorization for the Implementation of the Game of Progressive-21 Filed some time after Aug. 4, 1992.

Information Disclosure Statement Apr. 7, 1988 Describing "Sklansky's Casino Poker" and Video Poker Coin Hopper Model CH-500 and Model Number DH-750/U1 Literature Asahi Seiko 26 Jan. 1993.

Statement of Grounds and Particulars by John Huxley Ltd. in Opposition to Australian Patent Application No. 628044.

Casino Journal, vol. 8, No. 6, Jun. 1993 "So You Wanna Be A Gambler" pp. 1, 5.

*Primary Examiner*—Benjamin H. Layno

[57] ABSTRACT

In a poker game variation in which one or more players play against the house, the player(s) place bets and then three face-up hands consisting of two cards each are dealt. Player(s) each choose one of the three hands and then five communal cards are dealt face-up. In a first embodiment, all five communal cards are dealt face-up at one time, and then the winning hand(s) is determined by comparing the three hands in conjunction with the communal cards using poker rank as the criterion for comparison. Each player betting on the winning hand wins his or her bet. In a second embodiment, three of the five communal cards are turned face-up, after which all players have the option of surrendering one-half of their bet and folding. After the surrender opportunity, the remaining two communal cards are turned face-up and the winning hand determined using poker rank as the criterion for comparison. A third embodiment is identical to the second embodiment, with the exception that winning players are paid a bonus amount depending upon the poker rank of the winning hand. For example, a royal flush pays 50 to 1, a straight flush pays 20 to 1, etc. Live casino and video poker versions of each of the three embodiments of the game are disclosed. A novel gaming table layout for use in the live casino versions of the game is also disclosed.

97 Claims, 4 Drawing Sheets

U.S. PATENT DOCUMENTS

| | | | |
|---|---|---|---|
| 1,763,476 | 6/1930 | Morris | 273/309 |
| 3,269,503 | 8/1966 | Foster | 273/85 CP |
| 3,663,021 | 5/1972 | Whippo | 273/292 |
| 3,667,757 | 6/1972 | Holmberg | 273/274 |
| 3,825,255 | 7/1974 | Kennard et al. | 273/138 A |
| 3,876,208 | 4/1975 | Wachtler et al. | 273/138 A |
| 4,232,866 | 11/1980 | Pennachio | 273/374 |
| 4,305,586 | 12/1981 | Richards | 273/374 |
| 4,364,567 | 12/1982 | Goott | 273/237 |
| 4,518,001 | 5/1985 | Branham | 133/5 R |
| 4,531,187 | 7/1985 | Uhland | 364/412 |
| 4,614,342 | 9/1986 | Takashima | 273/85 CP |
| 4,648,604 | 3/1987 | Horan | 273/292 |
| 4,651,997 | 3/1987 | Wood | 273/274 |
| 4,759,549 | 7/1988 | Beckwith | 273/274 |
| 4,760,527 | 7/1988 | Sidley | 364/412 |
| 4,813,675 | 3/1989 | Greenwood | 273/138 A |
| 4,836,553 | 6/1989 | Suttle et al. | 273/292 |
| 4,837,728 | 6/1989 | Barrie et al. | 364/412 |
| 4,861,041 | 8/1989 | Jones et al. | 273/292 |
| 4,948,134 | 8/1990 | Suttle et al. | 273/85 CP |
| 5,022,653 | 6/1991 | Suttle et al. | 273/85 CP |
| 5,078,405 | 1/1992 | Jones et al. | 273/309 |
| 5,112,060 | 5/1992 | Jones | 273/309 |
| 5,257,810 | 11/1993 | Schorr et al. | 273/292 |

METHOD FOR PLAYING A POKER GAME

CROSS-REFERENCE TO RELATED APPLICATIONS

This is a continuation-in-part of application Ser. No. 07/800,631, filed Nov. 27, 1991 now U.S. Pat. No. 5,288,077; which is a continuation-in-part of application Ser. No. 07/361,276, filed Jun. 5, 1989 and now U.S. Pat. No. 5,078,405; which is a division of application Ser. No. 07/214,934, filed Jul. 5, 1988 and now U.S. Pat. No. 4,861,041; which is a continuation-in-part of application Ser. No. 07/182,374, filed Apr. 18, 1988 and now U.S. Pat. No. 4,863,553. The entire disclosures of each of the above referenced applications and patents are hereby incorporated by reference herein.

BACKGROUND OF THE INVENTION

The present invention relates to games, and more particularly pertains to a new type of poker game especially adapted for casino gambling, both in live table and electronic video formats.

As a leisure time activity, poker and other card games have fascinated the public for years. A deck of cards, a playing surface and a few participants are all that is needed to provide a recreational few hours away from the stress and strain of daily life. Five or seven card poker is a game that almost everyone knows how to play and many games have been developed using the same basic priority or rank order of winning poker hands: Royal Flush, Straight Flush, Four of a Kind, Full House, Flush, Straight, Three of a Kind, Two Pair, One Pair and High card(s) in Hand.

For one reason or another, it has been difficult to adapt the rules of poker into a casino table game in which each player plays against the house. In a conventional poker game, a plurality of players are each dealt a poker hand by one player who acts as the dealer. The player with the highest hand based on the established priority of poker hands wins. Each player in turn deals a hand as the game continues. It is not unknown to introduce wagering into the game, generally through the use of tokens or poker chips, which may or may not have a monetary value.

Many places, both within and without the United States, have legalized gaming and poker is one of the games of chance that is offered in both casinos and cardrooms. In a conventional cardroom poker game, the house provides a dealer, the playing cards, the table and chairs but does not play a hand. The house collects a nominal percentage of each player's bet (the "rake") which compensates the house for providing the facilities to the players. Alternatively, the house may charge each player a set amount per hand or for a specified length of time, say one-half hour. Each player is competing not against the house, but against all the other players with the highest hand winning the total of all the wagers made on that hand.

Many people do not like to play cardroom poker because each player is competing against his fellow players, not against the house. Many people would rather attempt to win money from an impersonal source, the house or the casino, rather than from their fellow players with whom they may be acquainted.

Cardroom poker also does not offer any bonus payments for particularly good hands. While a Royal Flush is a rare occurrence and generates a thrill for any poker player, the player collects the same total wager that he would have collected if all he needed to beat the other players was Three of a Kind.

Another conventional form of live table poker is known as "HOLDEM" or "TEXAS HOLDEM". In this variant, each player at the table is dealt, face-down, a hand consisting of two cards. After a betting round, the dealer turns face-up three communal cards known as the "FLOP". After another betting round, the dealer turns face-up one more communal card. Another betting round follows, after which the dealer turns face-up the last of the five communal cards. After a final betting round, the winning player(s) are determined by comparing the best five card hand each player can make using their own personal two card hand in conjunction with any three of the five communal cards, using poker rank as the criterion for comparison. The pot is then awarded to the winning player, or split among two or more winning players possessing hands of equal poker rank. In some variants, the game is played high-low split, with the pot split between the player having the highest ranking poker hand and the player having the lowest ranking poker hand. In all prior art variations of HOLDEM, the players compete against each other rather than against the house, and do not have the opportunity to select their two card hand from a plurality of hands dealt face-up. Also, there is no possibility in such known HOLDEM poker variants for more than one player to select or possess the identical hand.

SUMMARY OF THE INVENTION

The present invention discloses a poker game variation in which one or more players play against the house. Broadly, the invention is directed to a poker game variant in which a plurality of incomplete poker hands are dealt face-up after an initial betting round. Each player then selects one of the plurality of hands. More than one player may thus select the same hand. Subsequently, each of the plurality of hands are completed and thereafter compared using poker rank as the criterion for comparison to determine the winning hand(s). The player who selects the winning hand is designated as the winning player, and bets are then settled. In the event that more than one player selects the winning hand(s), then all such tieing players "push" and all other players lose their bets.

The initially incomplete plurality of face-up poker hands may be completed in a variety of different ways, within the scope of the present invention. For example, additional cards may be dealt face-up or face-down onto each of the plurality of hands, to complete a five or seven card poker hand. Alternatively, one or more communal cards may be dealt to be jointly used by each of the plurality of incomplete hands.

In one preferred embodiment of the invention, one or more players initially place bets, and then three hands consisting of two cards each are dealt face-up. Player(s) each choose only one of the three hands, and then a total of five communal cards are dealt face-up. In a first embodiment, all five communal cards are dealt face-up at one time, and then the winning hand(s) is determined by comparing the three hands in conjunction with the communal cards using poker rank as the criterion for comparison. Each player betting on the winning hand wins his or her bet, except in the event that two or more of the three hands have equal poker rank, in which case all players who did not select one of the winning hands lose their bets, and all remaining players "push" or tie with the house.

In a second embodiment, three of the five communal cards are turned face-up, after which all players have the option of surrendering one-half of their bet and folding. Alternatively, the surrender option may be conditioned on the player surrendering some other proportion of their bet, for example, two-thirds. After the surrender opportunity, the remaining two communal cards are turned face-up and the winning hand determined using poker rank as the criterion for comparison.

A third embodiment is identical to the first embodiment, with the exception that winning players are paid a bonus amount depending upon the poker rank of the winning hand. For example, a royal flush pays 50 to 1, a straight flush pays 20 to 1, etc. Live casino and video poker versions of each of the three embodiments of the game are disclosed.

A novel gaming table layout for use in the live casino version of the game is also disclosed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
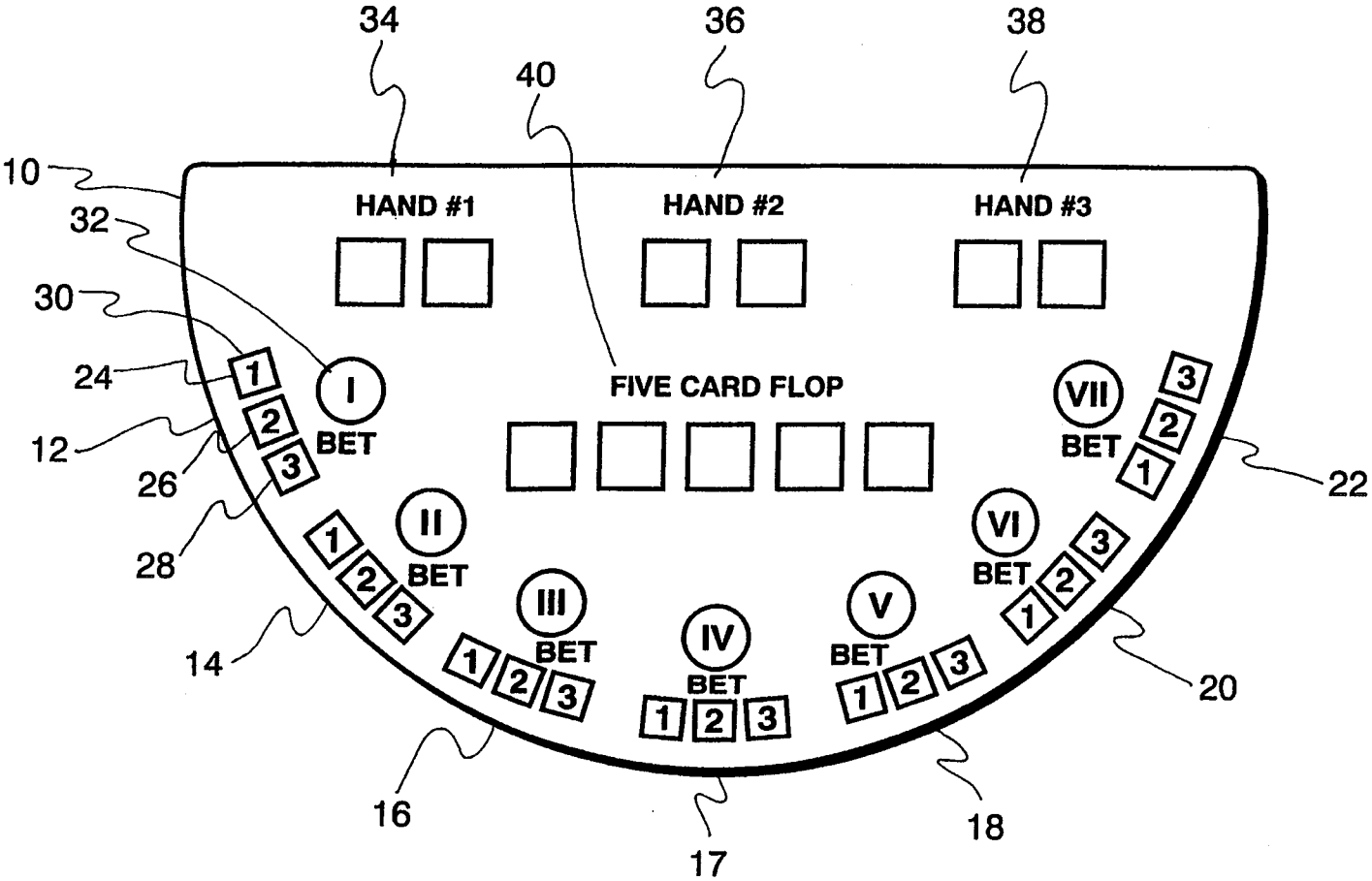
FIG. 1 is a plan view of a novel gaming table layout for use in the method of playing a live casino version of the poker game of the present invention.

Referring now to the drawings, wherein like reference numerals designate corresponding structure throughout the views, and referring in particular to FIG. 1, an improved layout 10 for use as a gaming table cover or top surface in playing live casino versions of the poker game according to three disclosed example embodiments of the invention includes a plurality of player locations 12, 14, 16, 17, 18, 20, and 22 spaced around an arcuate peripheral edge at which one or more players will sit or stand during play of the game. The dealer will stand or sit facing the players, behind the straight edge of the layout 10. The layout 10 may be formed from a felt material in a manner known in the art, for example, in connection with conventional Twenty-One table layouts. Alternatively, the layout may be physically incorporated into the surface of a gaming table. Each of the player locations, for example, player location 24, includes three sequentially numbered hand selection indicia 24, 26, and 28. By placing a marker 30, such as a chip or other token, upon one of the three selection indicia 24, 26, and 28, a player may select one of three two-card hands dealt during play by a dealer into designated hand locations 34 HAND #1, 36 HAND #2, and 38 HAND #3, each consisting of two adjacent rectangles printed on the layout 10 and dimensioned to receive standard playing cards. As an alternative to printed designations, the selection indicia may take the form of electric lights activated by push button switches, such that each player may select one of the hands by depressing a corresponding button. After such selection, illumination of an electric light, LED, or the like provides a positive visual indication of each player's selected hand. Such illuminated indicia preferably includes suitable logic circuitry to enable players to change their initial selection by pushing a different button until such time as the dealer activates a lock-out switch preventing further changes in hand selection. Such logic circuitry may also provide for prompting of player hand selection input at the appropriate time. Prompting may take the form of blinking indicia, or other visual or audible signal. The use of electronic selection indicia prevents potential disputes which might arise using manual manipulation of a marker by each player to select one of the three hands, as the marker is susceptible of inadvertent or intentional displacement after initial positioning. Each of the player locations may also include a bet box, for example bet box 32 at player location 12 designated by a circular printed zone on the layout 10. A centrally disposed communal card zone 40 on the layout 10 consists of five printed rectangular locations each dimensioned to receive one standard playing card.

Figure 2:
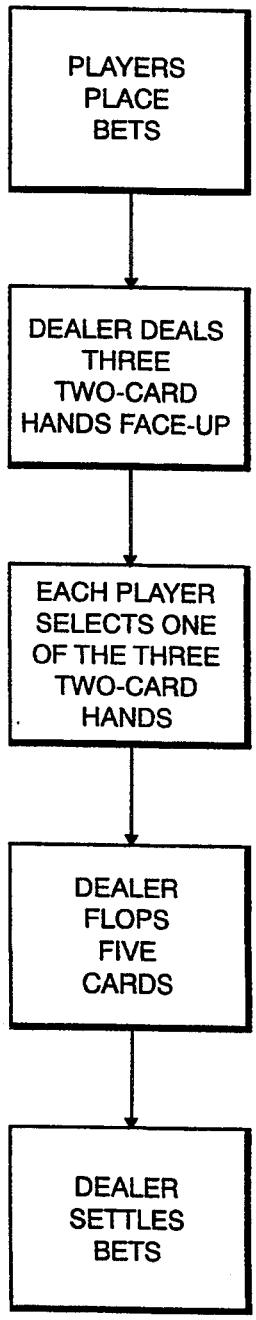
FIG. 2 is a flow chart illustrating a method of playing a poker game according to a first embodiment of the present invention.

With reference to FIGS. 1 and 2, the manner of play of a first embodiment of the poker variation of the present invention will now be described. One or more players sitting or standing in respective player locations 12, 14, 16, 17, 18, 20, and 22 initially make wagers, within a range determined by the house (casino) in accordance with applicable gambling laws and regulations, by placing the associated chips or other tokens in the bet box, for example, bet box 32. The dealer, who is preferably a suitably registered and certified casino employee, then deals three hands face-up, each consisting of two cards, in respective designated hand locations 34, 36, and 38. The player(s) then each select only one of the three hands by placing a marker 30 or the like onto one of the hand selection indicia 24, 26, or 28 at each player's location. For example, in FIG. 1, player I has selected HAND #1 by placing the marker 30 on hand selection indicia 24.

The dealer then deals face-up five communal cards in the communal card zone 40 designated by the indicia "FIVE CARD FLOP" printed on the layout 10. The three hands, HAND #1, HAND #2, and HAND #3 are then compared, in conjunction with the five communal cards, to determine the winning hand, using poker rank as the criterion for comparison. In conducting this comparison, the two cards from each of HAND #1, HAND #2, and HAND #3 are used along with the best three of the five communal cards to achieve the highest poker hand. Conventional poker rank, from highest to lowest, is set forth in the following table:

TABLE 1

| Hand | Poker Rank Example |
|---|---|
| Royal Flush | A, K, Q, J, 10 (suited) |
| Straight Flush | 3, 4, 5, 6, 7 (suited) |
| Four Of A Kind | 8, 8, 8, 8, 5 |
| Full House | 10, 10, 10, J, J |
| Flush | 3, 6, 8, J, Q (suited) |
| Straight | 5, 6, 7, 8, 9 (unsuited) |
| Three Of A Kind | Q, Q, Q, 2, 3 (unsuited) |
| Two Pair | A, A, J, J, 10 (unsuited) |
| One Pair | Q, Q, 4, 5, 9 (unsuited) |
| High Card In Hand | A, Q, 4, 5, 8 (unsuited) |

After conducting the comparison, the dealer settles bets. Each player betting on the winning hand wins his or her bet, except in the event that two or more of the three hands have equal poker rank, in which case all players who did not select one of the winning hands lose their bets, and all remaining players "push" or tie with the house.

Some example hands will be considered in order to convey a full and complete understanding of the game.

Example 1

HAND #1: A club, 5 heart
HAND #2: Q heart, 3 heart
HAND #3: 4 spade, 4 diamond
FLOP: A heart, J diamond, 9 spade, 6 club, 2 heart
HAND #1 is the winning hand because the pair of aces is the highest of the three hands.

Example 2

HAND #1: A club, 5 heart
HAND #2: Q heart, 3 heart
HAND #3: 4 spade, 4 diamond
FLOP: A heart, J heart, 9 spade, 6 club, 2 heart
HAND #2 is the winning hand because the heart flush consisting of Q, 3, A, J, 2 is the highest hand.

Example 3

HAND #1: A club, 5 heart
HAND #2: Q heart, 3 heart
HAND #3: 4 spade, 4 diamond
FLOP: A heart, J heart, J spade, 6 club, 4 heart
HAND #3 is the winning hand because the 4, 4, 4, J, J full house is the highest hand, beating both the HAND #1-A, A, J, J, 6 two-pair and the HAND #2-Q, 3, A, J, 4 heart flush.

Example 4

HAND #1: A club, 5 heart
HAND #2: A heart, 5 club
HAND #3: A diamond, 5 spade
FLOP: 2 heart, 3 club, 4 spade, J club, 9 heart All of the hands have an equal Ace through five straight poker rank, resulting in a three-way push and the return of each player's wager.

As can now be appreciated, the present invention presents players with the opportunity to make an educated "guess" in the initial selection of one of the three hands. In contrast with conventional card games, all players have the opportunity to select and root for the same hand, engendering a spirit of camaraderie similar to that found at horse races. This is in marked contrast to the cut-throat competitive spirit present in conventional poker games.

Figure 3:
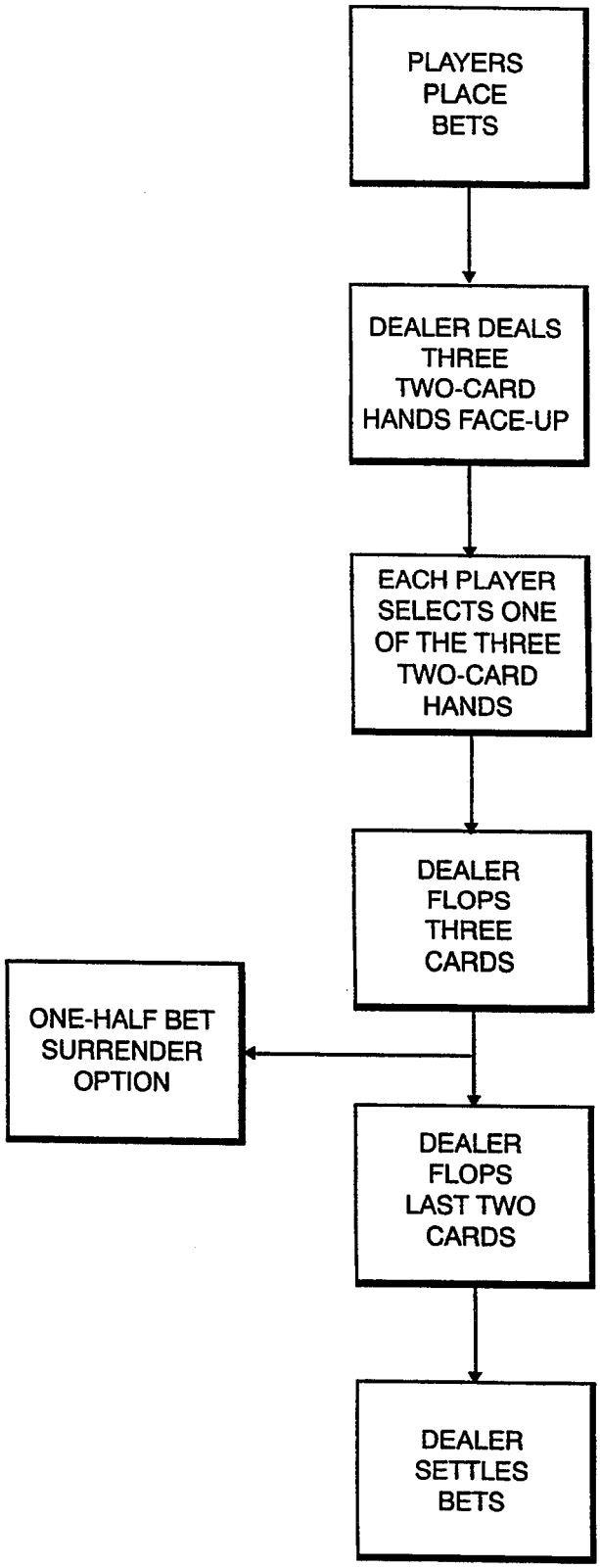
FIG. 3 is a flow chart illustrating a method of playing a poker game according to an alternative embodiment of the present invention.

With reference now to FIGS. 1 and 3, a manner of playing the game according to a second embodiment of the invention will now be described. One or more players sitting or standing in respective player locations 12, 14, 16, 17, 18, 20, and 22 initially make wagers, within a range determined by the house (casino) in accordance with applicable gambling laws and regulations, by placing the associated chips or other tokens in the bet box, for example, bet box 32. The dealer, who is preferably a suitably registered and certified casino employee, then deals three hands face-up, each consisting of two cards, in respective designated hand locations 34, 36, and 38. The player(s) then each select only one of the three hands by placing a marker 30 or the like onto one of the hand selection indicia 24, 26, or 28 at each player's location. For example, in FIG. 1, player I has selected HAND #1 by placing the marker 30 on hand selection indicia 24. The dealer then deals face-up three communal cards in the communal card zone 40 designated by the indicia "FIVE CARD FLOP" printed on the layout 10. The player(s) are then each afforded an opportunity to surrender one-half of their wager and fold. After each of the player(s) makes the surrender or stay decision, the dealer deals two additional communal cards face-up, resulting in a total of five communal cards in zone 40. The three hands, HAND #1, HAND #2, and HAND #3 are then compared, in conjunction with the five communal cards, to determine the winning hand, using poker rank as the criterion for comparison, as described above in connection with the first embodiment of the present invention. In conducting this comparison, the two cards from each of HAND #1, HAND #2, and HAND #3 are used along with the best three of the five communal cards to achieve the highest poker hand. After conducting the comparison, the dealer settles bets. Each player betting on the winning hand wins his or her bet, except in the event that two or more of the three hands have equal poker rank, in which case all players who did not select one of the winning hands lose their bets, and all remaining players "push" or tie with the house.

In a third embodiment of the invention, the manner of play is identical with the manner of play of the first embodiment described above, with the exception that winning players (players who selected the winning hand in the absence of any tie or push) are paid a bonus amount depending upon the poker rank of the winning hand in accordance with the following table:

TABLE 2

| Poker Rank of Winning Hand | Payoff Odds Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1 |

While the three alternative embodiments described above are the preferred forms of the game of the present invention, other variants may also be practiced within the scope of the invention. For example, the three hands HAND #1, HAND #2, and HAND #3, may consist of one card or more than two cards. Also, more or less than three hands may be dealt. Similarly, the number of communal cards may be more or less than five, and may be dealt all at once or in any possible order and combination. In the live casino versions of the three variants, the cards are preferably dealt from a single conventional fifty-two card deck which is reshuffled after every hand. Alternatively, a deck shoe consisting of a plurality of ordinary fifty-two card decks shuffled together, may be employed in order to minimize reshuffling time between hands.

The present invention, in addition to the live table casino version of each of the three embodiments of the game described above, also contemplates video poker versions of each of the three embodiments. A suitable electronic video poker device of the general type suitable for use in the practice of the three alternative embodiments of the game according to the present invention is disclosed in U.S. Pat. No. 4,948,134, which issued Aug. 14, 1990, and the entire disclosure of which is incorporated by reference herein.

Figure 4:
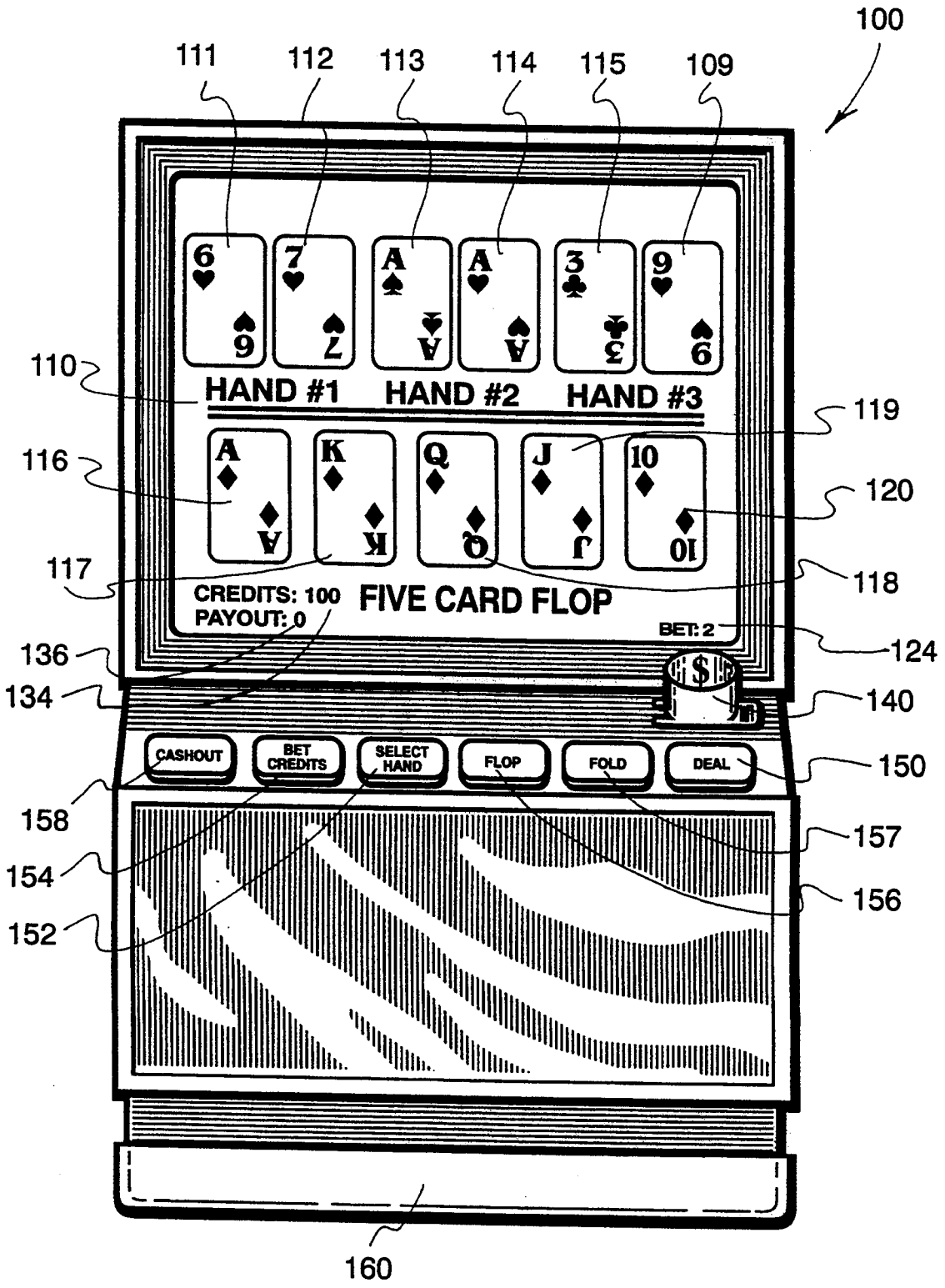
FIG. 4 is a front elevational view illustrating a video poker machine for use in playing the poker game according to the present invention.

As depicted in FIG. 4, the electronic video poker device 100 includes a display screen 110 operative in a well known manner to display representations of conventional playing cards thereon. In accordance with the present invention, the CPU (not shown) of the device 100 is instructed pursuant to a program which may, for example, be stored in a PROM component of the internal circuitry. The PROM stored program code may be selectively determined, within the ambit of a programmer of ordinary skill in the art, having the benefit of the instant disclosure, to enable the electronic device 100 to play any one or more of the three alternative embodiments of the game described above. An upper portion of the screen 110 is operative to display, face-up, three hands, each consisting of two cards. HAND #1 consists of screen card representations 111, 112; HAND #2 consists of screen card representations 113, 114; HAND #3 consists of screen card representations 115, 109. In accordance with generally known technology in the field of video poker machines, the CPU of the device 100, under appropriate program instruction, may accurately simulate the random dealing of each of the three hands from a shuffled conventional fifty-two card deck.

A lower portion of the screen 110, designated by the indicia "FIVE CARD FLOP" is similarly operative to display representations of five communal cards 116, 117, 118, 119, and 120. An LED display 124 displays the value of the current bet, for example 2 tokens (which tokens may represent, for example, nickels, dimes, quarters, dollars, etc.) and similar LED displays 134 and 136 display the number of accumulated credits (i.e. tokens) and the number of tokens paid out, respectively. A coin acceptor 140 is operative to receive wager tokens, or alternatively, coins and/or bills. A plurality of control buttons 150, 152, 154, 156, 157, and 158 allow the player to make control inputs during play of the game of the present invention. In an example manner of play of the electronic video poker device 100, a player first puts tokens or coins into the acceptor 140 to acquire a credit balance on LED CREDIT display 134. If so desired, the player may alternatively place each bet individually after each hand by inserting coins, tokens, or bills. The player then pushes the BET CREDITS button 154 one or more times to place a wager which is displayed by BET display 124. The electronic device 100 may be programmed to limit the number of tokens that can be bet on a single hand to, for example, five. After the player is satisfied with the amount bet, the player pushes the DEAL button 150, which causes the device 100 to "deal" face-up the three two-card hands, HAND #1, HAND #2, and HAND #3. The player then pushes the SELECT HAND button 152 one or more times to select one of the three hands. A suitable visual indication of the hand selected is preferably provided. For example, the HAND #1 indicia may be illuminated if the player selects that hand. After the player is satisfied with the selected hand, the player then pushes the FLOP button 150, causing the device 100 to "deal" communal cards face-up in the FIVE CARD FLOP zone. For example, if the device 100 is programmed to play the game according to the second embodiment of the invention described above, three of the five communal cards 116, 117, 118, 119, and 120 are dealt face-up at this time. The player then is afforded an opportunity to surrender one-half his or her bet and fold by depressing the FOLD button 150, or the player may continue the hand by again depressing the FLOP button 156, causing the device to deal the remaining two communal cards face-up. The device 100 may be programmed to suitably prompt the player for required control inputs during the course of play. For example, one or more of the control buttons may flash when activation of such buttons is a current player option or input requirement. The device 100 then automatically compares the three hands and determines whether the player selected the winning hand, and makes an appropriate electronic or physical settlement of the wager. Paid out coins or tokens may be dispensed into tray 160 for collection or storage by the player. When a player wishes to cease play, any accumulated credits may be refunded by depressing the CASHOUT button 158.

As may now be readily understood, the device 100 may be programmed to play any of the three alternative embodiments of the game of the present invention described above. Alternatively, the device may include a control input to allow a player to select play of any one of the three variations. In connection with the third alternative embodiment, the device 100 may be programmed to make appropriate bonus payouts in accordance with the odds set forth in Table 2 above.

In addition to the three example embodiments of the invention described in detail above, other variants may also be practiced within the scope of the present invention. Instead of completing the initially incomplete plurality of face-up hands by using communal cards, cards may be separately dealt to each of the plurality of face-up hands. In this form, the game may simulate five or seven card stud poker. As can be readily appreciated, the number of cards initially dealt face-up to form the incomplete hands may be varied. If fewer cards are dealt face-up before player selection of a hand, then it is more difficult for players to select the ultimately winning hand, because less initial information is available. Similarly, if more cards are initially dealt in each of the incomplete hands prior to player selection, then the players' winning chances are increased.

It is further contemplated that each of the embodiments of the game disclosed herein may include a progressive jackpot feature, as disclosed in U.S. Pat. No. 4,861,041 issued to Daniel A. Jones and James P. Suttle on Aug. 29, 1989, the entire disclosure of which is hereby incorporated by reference herein. In connection with the three example embodiments described above, in which a plurality of initially incomplete two card face-up hands are completed by five communal cards, it is preferred that the progressive jackpot be paid out on only the first five cards in each hand, i.e. the initial two face-up cards plus the first three communal cards. As described in U.S. Pat. No. 4,861,041, the progressive jackpot feature entails a separate jackpot wager, for example by placing a chip or betting token in a slot in or adjacent to the gaming table or electronic video poker machine, apart from the bets associated with the usual play of the game. If the winning hand comprises a predetermined arrangement of cards, a player selecting the winning hand wins at least a portion of the jackpot. This may be either a fixed amount of chips or tokens, or a percentage of the current jackpot total value. Preferred jackpot payout amounts are set forth in the following table:

TABLE 3

| Jackpot Payout | |
|---|---|
| Poker Rank Of Winning Hand | Payout Amount |
| Royal Flush | 100% |
| Straight Flush | 10% |
| Four of a Kind | 1% |
| Full House | 50 tokens |
| Flush | 25 tokens |

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A method of playing a poker game, comprising the steps of:

dealing at least three hands each consisting of a first predetermined number of cards including at least one face-up card;

requiring one or more players, after viewing said hands, to each select one of said hands;

turning face-up a second predetermined number of at least one communal card; and comparing each of said hands, in conjunction with said at least one communal card, using poker rank as the criterion for comparison to determine a winning hand; and designating as a winner each player who selected said winning hand.

2. The method of claim 1, wherein said first predetermined number of cards consists of two cards.

3. The method of claim 2, wherein said second predetermined number of communal cards consists of five cards.

4. The method of claim 3, wherein all cards in each of said hands are dealt face-up.

5. The method of claim 4, further comprising the step of requiring each player to place a bet before said step of dealing said hands; and paying each winning player after said step of designating winning players.

6. The method of claim 5, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

7. The method of claim 5, wherein said step of paying the winning player includes the step of paying the winning player a bonus amount depending upon the poker rank of the winning hand.

8. The method of claim 3, further comprising the step of requiring each player to place a bet before said step of dealing said hands; and paying each winning player after said step of designating winning players.

9. The method of claim 8, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

10. The method of claim 8, wherein said step of paying the winning player includes the step of paying the winning player a bonus amount depending upon the poker rank of the winning hand.

11. The method of claim 2, wherein all cards in each of said hands are dealt face-up.

12. The method of claim 11, further comprising the step of requiring each player to place a bet before said step of dealing said hands; and paying each winning player after said step of designating winning players.

13. The method of claim 12, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

14. The method of claim 12, wherein said step of paying the winning player includes the step of paying the winning player a bonus amount depending upon the poker rank of the winning hand.

15. The method of claim 2, further comprising the step of requiring each player to place a bet before said step of dealing said hands; and paying each winning player after said step of designating winning players.

16. The method of claim 15, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

17. The method of claim 15, wherein said step of paying the winning player includes the step of paying the winning player a bonus amount depending upon the poker rank of the winning hand.

18. The method of claim 1, wherein said second predetermined number of communal cards consists of five cards.

19. The method of claim 18, wherein all cards in each of said hands are dealt face-up.

20. The method of claim 19, further comprising the step of requiring each player to place a bet before said step of dealing said hands; and paying each winning player after said step of designating winning players.

21. The method of claim 20, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

22. The method of claim 20, wherein said step of paying the winning player includes the step of paying the winning player a bonus amount depending upon the poker rank of the winning hand.

23. The method of claim 18, further comprising the step of requiring each player to place a bet before said step of dealing said hands; and paying each winning player after said step of designating winning players.

24. The method of claim 23, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

25. The method of claim 23, wherein said step of paying the winning player includes the step of paying the winning player a bonus amount depending upon the poker rank of the winning hand.

26. The method of claim 1, wherein all cards in each of said hands are dealt face-up.

27. The method of claim 26, further comprising the step of requiring each player to place a bet before said step of dealing said hands; and paying each winning player after said step of designating winning players.

28. The method of claim 27, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

29. The method of claim 27, wherein said step of paying the winning player includes the step of paying the winning player a bonus amount depending upon the poker rank of the winning hand.

30. The method of claim 1, further comprising the step of requiring each player to place a bet before said step of dealing said hands; and paying each winning player after said step of designating winning players.

31. The method of claim 30, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

32. The method of claim 30, wherein said step of paying the winning player includes the step of paying the winning player a bonus amount depending upon the poker rank of the winning hand.

33. The method of claim 30, including a jackpot component associated with said game and comprising the further steps of:

requiring each player wishing to participate in said jackpot component to place a wager separate and distinct from said bet prior to said step of dealing said hands;

designating as a jackpot winner each player participating in said jackpot whose completed selected hand comprises a predetermined arrangement of cards; and awarding a preselected portion of the jackpot to each jackpot winner.

34. The method of claim 33, wherein said predetermined arrangement of cards and the preselected winning amount are as follows:

| | |
|---|---|
| Royal Flush | 100% |
| Straight Flush | 10% |
| Four of a Kind | 1% |
| Full House | 50 tokens |
| Flush | 25 tokens. |

35. The method of claim 33, wherein said preselected winning amount comprises a percentage of the current jackpot value.

36. The method of claim 33, wherein said preselected winning amount comprises a fixed amount.

37. The method of claim 1, wherein said poker game is played on an electronic device and said cards comprise electronically produced visual representations of playing cards.

38. The method of claim 1, wherein said poker game is played in a live form on a gaming table with a human dealer and conventional playing cards.

39. A method of playing a poker game, comprising the steps of:

requiring each player to place a bet;

dealing at least three hands face-up, each of said hands consisting of two cards;

requiring each player, after viewing said hands, to select one of said hands;

turning face-up five communal cards;

comparing each of said hands, in conjunction with said communal cards, using poker rank as the criterion for selection to determine a winning hand;

designating as a winner each player who selected a winning hand; and paying each winning player a bonus amount depending upon the poker rank of the winning hand.

40. The method of claim 39, wherein said step of paying each winning player a bonus amount includes the step of paying each winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

41. The method of claim 39, wherein said poker game is played on an electronic device and said cards comprise electronically produced visual representations of playing cards.

42. The method of claim 39, wherein said poker game is played in a live form on a gaming table with a human dealer and conventional playing cards.

43. The method of claim 39, including a jackpot component associated with said game and comprising the further steps of:

requiring each player wishing to participate in said jackpot component to place a wager separate and distinct from said bet prior to said step of dealing said hands;

designating as a jackpot winner each player participating in said jackpot whose completed selected hand comprises a predetermined arrangement of cards; and awarding a preselected portion of the jackpot to each jackpot winner.

44. The method of claim 43, wherein said predetermined arrangement of cards and the preselected winning amount are as follows:

| | |
|---|---|
| Royal Flush | 100% |
| Straight Flush | 10% |
| Four of a Kind | 1% |
| Full House | 50 tokens |
| Flush | 25 tokens. |

45. The method of claim 43, wherein said preselected winning amount comprises a percentage of the current jackpot value.

46. The method of claim 43, wherein said preselected winning amount comprises a fixed amount.

47. A method of playing a poker game, comprising the steps of:

requiring each player to place a bet;

dealing at least three hands face-up, each of said hands consisting of two cards;

requiring each player, after viewing said hand, to select one of said hands;

turning face-up five communal cards;

comparing each of said hands, in conjunction with said communal cards, using poker rank as the criterion for selection to determine a winning hand;

designating as a winner each player selecting a winning hand; and paying winning players according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

48. The method of claim 47, wherein said poker game is played on an electronic device and said cards comprise electronically produced visual representations of playing cards.

49. The method of claim 47, wherein said poker game is played in a live form on a gaming table with a human dealer and conventional playing cards.

50. The method of claim 47, including a jackpot component associated with said game and comprising the further steps of:

requiring each player wishing to participate in said jackpot component to place a wager separate and distinct from said bet prior to said step of dealing said hands;

designating as a jackpot winner each player participating in said jackpot whose completed selected hand comprises a predetermined arrangement of cards; and awarding a preselected portion of the jackpot to each jackpot winner.

51. The method of claim 50, wherein said predetermined arrangement of cards and the preselected winning amount are as follows:

| | |
|---|---|
| Royal Flush | 100% |
| Straight Flush | 10% |
| Four of a Kind | 1% |
| Full House | 50 tokens |
| Flush | 25 tokens. |

52. The method of claim 50, wherein said preselected winning amount comprises a percentage of the current jackpot value.

53. The method of claim 50, wherein said preselected winning amount comprises a fixed amount.

54. A method of playing a poker game, comprising the steps of:

requiring each player to place a bet;

dealing three hands face-up, each of said hands consisting of two cards;

requiring each player, after viewing said hands, to select one of said three of hands;

turning face-up five communal cards;

comparing each of said hands, in conjunction with said communal cards, using poker rank as the criterion for selection to determine a winning hand;

designating as a winner each player selecting a winning hand; and paying winning players.

55. The method of claim 54, wherein said step of paying the winning player includes the step of paying the winning player a bonus amount depending upon the poker rank of the winning hand.

56. The method of claim 54, wherein said step of paying the winning player includes the step of paying the winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

57. The method of claim 54, wherein said poker game is played on an electronic device and said cards comprise electronically produced visual representations of playing cards.

58. The method of claim 54, wherein said poker game is played in a live form on a gaming table with a human dealer and conventional playing cards.

59. The method of claim 54, including a jackpot component associated with said game and comprising the further steps of:

requiring each player wishing to participate in said jackpot component to place a wager separate and distinct from said bet prior to said step of dealing said hands;

designating as a jackpot winner each player participating in said jackpot whose completed selected hand comprises a predetermined arrangement of cards; and awarding a preselected portion of the jackpot to each jackpot winner.

60. The method of claim 59, wherein said predetermined arrangement of cards and the preselected winning amount are as follows:

| | |
|---|---|
| Royal Flush | 100% |
| Straight Flush | 10% |
| Four of a Kind | 1% |
| Full House | 50 tokens |
| Flush | 25 tokens. |

61. The method of claim 59, wherein said preselected winning amount comprises a percentage of the current jackpot value.

62. The method of claim 59, wherein said preselected winning amount comprises a fixed amount.

63. A method of playing a poker game, comprising the steps of:

requiring each player to place a bet;

dealing three hands face-up, each of said hands consisting of two cards;

requiring each player, after viewing said hands, to select selecting one of said three hands;

turning face-up five communal cards;

comparing each of said three hands, in conjunction with said communal cards, to each other hand of said three hands using poker rank as the criterion for selection to determine the winning hand or hands;

in the event that there are exactly three winning hands having equivalent poker ranks, returning all players' bets;

in the event that there are exactly two winning hands having equivalent poker ranks, returning bets to only each player who selected one of the two winning hands; and in the event that there is exactly one winning hand, paying off only each player who selected the winning hand.

64. The method of claim 63, wherein said step of paying off only each player who selected the winning hand includes the step of paying a bonus amount depending upon the poker rank of the winning hand.

65. The method of claim 63, wherein said step of paying off only each player who selected the winning hand includes the step of paying a bonus amount according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

66. The method of claim 63, wherein said poker game is played on an electronic device and said cards comprise electronically produced visual representations of playing cards.

67. The method of claim 63, wherein said poker game is played in a live form on a gaming table with a human dealer and conventional playing cards.

68. The method of claim 63, including a jackpot component associated with said game and comprising the further steps of:

requiring each player wishing to participate in said jackpot component to place a wager separate and distinct from said bet prior to said step of dealing said hands;

designating as a jackpot winner each player participating in said jackpot whose completed selected hand comprises a predetermined arrangement of cards; and awarding a preselected portion of the jackpot to each jackpot winner.

69. The method of claim 68, wherein said predetermined arrangement of cards and the preselected winning amount are as follows:

| | |
|---|---|
| Royal Flush | 100% |
| Straight Flush | 10% |
| Four of a Kind | 1% |
| Full House | 50 tokens |
| Flush | 25 tokens. |

70. The method of claim 68, wherein said preselected winning amount comprises a percentage of the current jackpot value.

71. The method of claim 68, wherein said preselected winning amount comprises a fixed amount.

72. A method of playing a poker game, comprising the steps of:

requiring each player to place a bet;

dealing at least three hands each consisting of a first predetermined number of cards including at least one face-up card;

requiring each player, after viewing said hands, to select one of said hands;

turning face-up a second predetermined number of communal cards;

allowing each player the option to surrender a predetermined portion of their bet and fold after seeing said second predetermined number of communal cards;

turning face-up a third predetermined number of communal cards;

comparing each of said hands, in conjunction with said communal cards, using poker rank as the criterion for selection to determine the winning hand; and paying off each player who selected the winning hand.

73. The method of claim 72, wherein said step of paying off each winning player includes the step of paying each winning player a bonus amount depending upon the poker rank of the winning hand.

74. The method of claim 72, wherein said step of paying off each winning player includes the step of paying each winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

75. The method of claim 72, wherein said poker game is played on an electronic device and said cards comprise electronically produced visual representations of playing cards.

76. The method of claim 72, wherein said poker game is played in a live form on a gaming table with a human dealer and conventional playing cards.

77. The method of claim 72, including a jackpot component associated with said game and comprising the further steps of:

requiring each player wishing to participate in said jackpot component to place a wager separate and distinct from said bet prior to said step of dealing said hands;

designating as a jackpot winner each player participating in said jackpot whose completed selected hand comprises a predetermined arrangement of cards; and awarding a preselected portion of the jackpot to each jackpot winner.

78. The method of claim 77, wherein said predetermined arrangement of cards and the preselected winning amount are as follows:

| | |
|---|---|
| Royal Flush | 100% |
| Straight Flush | 10% |
| Four of a Kind | 1% |
| Full House | 50 tokens |
| Flush | 25 tokens. |

79. The method of claim 77, wherein said preselected winning amount comprises a percentage of the current jackpot value.

80. The method of claim 77, wherein said preselected winning amount comprises a fixed amount.

81. A method of playing a poker game, comprising the steps of:

dealing at least three incomplete hands each consisting of a first predetermined number of cards including at least one face-up card;

requiring one or more players, after viewing said hands, to each select one of said incomplete hands;

completing said hands with additional cards;

comparing each of said hands using poker rank as the criterion for comparison to determine a winning hand; and designating as a winner each player who selected said winning hand.

82. The method of claim 81, wherein said step of completing said hands with additional cards comprises dealing face-up at least one communal card.

83. The method of claim 81, wherein said step of completing said hands with additional cards comprises dealing at least one additional card to each of said hands.

84. The method of claim 81, wherein said poker game is played on an electronic device and said cards comprise electronically produced visual representations of playing cards.

85. The method of claim 81, wherein said poker game is played in a live form on a gaming table with a human dealer and conventional playing cards.

86. A method of playing a poker game, comprising the steps of:

requiring each player to place a bet;

dealing at least three hands face-up, each of said hands including at least one card;

requiring each player, after viewing said hands to select one of said hands;

completing each of said hands with at least one additional card;

comparing each of said hands to each other hand of said hands using poker rank as the criterion for selection to determine the winning hand or hands;

designating as a winner each player who selected said winning hand; and settling bets.

87. The method of claim 86, including a jackpot component associated with said game and comprising the further steps of:

requiring each player wishing to participate in said jackpot component to place a wager separate and distinct from said bet prior to said step of completing each of said hands;

designating as a jackpot winner each player participating in said jackpot whose completed selected hand comprises a predetermined arrangement of cards; and awarding a preselected portion of the jackpot to each jackpot winner.

88. The method of claim 87, wherein said predetermined arrangement of cards and the preselected winning amount are as follows:

| | |
|---|---|
| Royal Flush | 100% |
| Straight Flush | 10% |
| Four of a Kind | 1% |
| Full House | 50 tokens |
| Flush | 25 tokens. |

89. The method of claim 87, wherein said preselected winning amount comprises a percentage of the current jackpot value.

90. The method of claim 87, wherein said preselected winning amount comprises a fixed amount.

91. The method of claim 86, wherein said step of settling bets includes the step of paying each winning player a bonus amount depending upon the poker rank of the winning hand.

92. The method of claim 86, wherein said step of settling bets includes the step of paying each winning player according to the odds set forth in the following table depending upon the poker rank of the winning hand:

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1. |

93. The method of claim 86, wherein said poker game is played on an electronic device and said cards comprise electronically produced visual representations of playing cards.

94. The method of claim 86, wherein said poker game is played in a live form on a gaming table with a human dealer and conventional playing cards.

95. A method of playing a poker game, comprising the steps of:

requiring each player to place a bet;

dealing at least two hands each consisting of a first predetermined number of cards including at least one face-up card; requiring one or more players, after viewing said hands, to each select one of said hands;

turning face-up a second predetermined number of at least one communal card; and comparing each of said hands, in conjunction with said at least one communal card, using poker rank as the criterion for comparison to determine a winning hand;

designating as a winner each player who selected said winning hand; and settling bets.

96. A method of playing a poker game, comprising the steps of:

requiring each player to place a bet;

dealing at least two hands face-up, each of said hands consisting of two cards;

requiring each player, after viewing said hands, to select one of said three hands;

turning face-up five communal cards;

comparing each of said three hands, in conjunction with said communal cards, to each other hand of said three hands using poker rank as the criterion for selection to determine the winning hand or hands;

in the event that there are exactly three winning hands having equivalent poker ranks, returning all players' bets;

in the event that there are exactly two winning hands having equivalent poker ranks, returning bets to only each player who selected one of the two winning hands; and in the event that there is exactly one winning hand, paying off only each player who selected the winning hand.

97. A method of playing a poker game, comprising the steps of:

requiring each player to place a bet;

dealing at least two hands face-up, each of said hands including at least one card;

requiring each player, after viewing said hands to select one of said hands;

completing each of said hands with at least one additional card;

comparing each of said hands to each other hand of said hands using poker rank as the criterion for selection to determine the winning hand or hands;

designating as a winner each player who selected said winning hand; and settling bets.

* * * * *